United States Patent [19]

Grushkin et al.

[11] Patent Number: 4,886,729

[45] Date of Patent: Dec. 12, 1989

[54] POSITIVELY CHARGED LIQUID DEVELOPER COMPOSITIONS

[75] Inventors: Bernard Grushkin, Pittsford; David E. Hutka; Louis V. Isganitis, both of Rochester; Edward J. Radigan, Hamlin, all of N.Y.

[73] Assignee: Xerox Corporation, Stamford, Conn.

[21] Appl. No.: 219,117

[22] Filed: Jul. 15, 1988

[51] Int. Cl.[4] ..... G03G 9/16

[52] U.S. Cl. ..... 430/114; 430/115; 430/126

[58] Field of Search ..... 430/107, 109, 110, 112, 430/114, 115, 126

[56] References Cited

U.S. PATENT DOCUMENTS

| | | | |
|---|---|---|---|
| 2,997,398 | 8/1961 | Kronstein et al. | 106/14 |
| 3,082,171 | 3/1963 | Shoemaker et al. | 252/62.1 |
| 3,166,510 | 1/1965 | West et al. | 430/110 |
| 3,926,825 | 12/1975 | Honjo et al. | 252/62.1 |
| 4,056,494 | 11/1977 | Kronstein et al. | 260/22 A |
| 4,252,565 | 8/1981 | Irvine et al. | 106/241 |
| 4,275,136 | 6/1981 | Murasawa et al. | 430/117 |
| 4,305,853 | 12/1981 | Kronstein et al. | 260/22 A |
| 4,476,210 | 10/1984 | Croucher et al. | 430/114 |
| 4,520,153 | 5/1985 | Kronstein et al. | 524/145 |
| 4,539,284 | 9/1985 | Barbetta et al. | 430/110 |

*Primary Examiner*—John L. Goodrow
*Attorney, Agent, or Firm*—E. O. Palazzo

[57] ABSTRACT

A positively charged liquid developer composition comprised of polymer particles, a hydrocarbon liquid component, a charge director comprised of lecithin, and as pigment particles the beta crystalline form of copper phthalocyanine.

15 Claims, No Drawings

POSITIVELY CHARGED LIQUID DEVELOPER COMPOSITIONS

BACKGROUND OF THE INVENTION

This invention is generally directed to positively charged liquid developer compositions, and moe specifically positively charged liquid developers comprised of a lecithin charge director and a specific blue pigment. More specifically, in one embodiment the present invention is directed to liquid developer compositions comprised of polymer particles, nonpolar dispersant liquids, the charge director lecithin, and a specific blue pigment available from BASF Corporation. The aforementioned liquid developer compositions of the present invention can be selected for development of images in various processes inclusive of xerographic processes, elecgtrostatic printing, and facsimile systems; color proofing processes; and the processes as illustrated in British Patent Publication No. 2,169,416, published July 9, 1986, the disclosure of which is totally incorporated herein by reference. Preferably, the positively charged liquid developer compositions of the present invention ae useful in imaging systems having incorporated therein imaging members, particularly layered imaging members that have been negatively charged, reference for example U.S. Pat. No. 4,265,990, the disclosure of which is totally incorporated herein by reference.

Numerous patents disclose liquid developer compositions inclusive of negatively charged liquid developers with charge directors such as lecithin. There is disclosed in U.S. Pat. No. 3,554,946 liquid developers for electrophotography comprised of a carrier liquid consisting of a hydrocarbon, negatively electrostatically charged toner particles dispersed in the carrier liquid, and a pigment therein such as carbon black, aniline black, prussian blue, phthalocyanine red, and cadmium yellow. In accordance with the teachings of this patent, a copolymer is coated on the surface of the pigment particles for the primary purpose of imparting a negative electrostatic charge to these particles. Other patents disclosing similar liquid developer compositions include Nos. 3,623,986; 3,625,897; 3,900,412; 3,976,583; 4,081,391 and 3,900,412. In the '412 patent, there is specifically disclosed a stable developer comprised of a polymer core with a steric barrier attached to the surface of the polymer selected. In column 15 of this patent, there are disclosed colored liquid developers by selecting pigments or dyes, and physically dispersing them by ball milling or high shear mixing. Attempts to obtain color liquid developer compositions by the ball milling process described have been unsuccessful, particularly with respect to obtaining developed images of acceptable optical density in that, for example, the desired size for the latex particles is from 0.2 to 0.3 micron in diameter; and with ball milling techniques it is very difficult to provide a dispersion of carbon black or other pigment particles much smaller in size than about 0.7 to about 0.8 micron. Consequently, the addition of carbon black pigment particles, for example, to latex particles with a diameter of 0.2 to 0.3 micron result after ball milling in relatively small latex particles residing on the surface of the pigment particles.

Additionally, there is described in U.S. Pat. No. 4,476,210, the diclosure of which is totally incorporated herein by reference, liquid developers containing an insulting liquid dispersion medium with marking particles therein, which particles are comprised of a thermoplastic resin core substantially insoluble in the dispersion, an amphipathic block or graft copolymeric stabilizer irreversibly chemically or physically anchored to the thermoplastic resin core, and a colored dye imbibed in the thermoplastic resin core. The history and evolution of liquid developers is provided in the '210 patent, reference columns 1 and 2 thereof.

With further regard to the British Pat. Publication No. 2,169,416, the disclosure of which is totally incorporated herein by reference, there are illustrated liquid developer compositions comprised of toner particles associated with a pigment dispersed in a nonpolar liquid, and wherein the toner particles are formulated with a plurality of fibers or tendrils from a thermoplastic polymer, and possess a charge of polarity opposite to the polarity of the latent image.

Furthermore, there is illustrated in copending application U.S. Ser. No. 846,164, the disclosure of which is totally incorporated herein by reference, stable black liquid developers comprised of an insulating liquid medium having dispersed therein black marking particles comprised of a thermoplastic resin core which is substantially insoluble in the dispersion medium, and chemically or physically anchored to the resin core an amphipathic block or graft copolymer steric stabilizer which is soluble in the dispersion medium; and wherein dyes comprised of a specific mixture are imbibed in the thermoplastic resin core with the mixture of dyes being dispersible at the molecular level, and therefore soluble in the thermoplastic resin core and insoluble in the dispersion medium. Furthermore, in copending application U.S. Ser. No. 946,548, the disclosure of which is totally incorporated herein by reference, there is illustrated dyed sterically stabilized polymer particle for incorporation into negatively charged electrophoretic liquid developers.

Of particular interest with respect to the invention of the present application is U.S. Pat. No. 3,926,825, which discloses a positive liquid developer containing a phthalocyanine, see for example working Example 3; however, there does not appear to be any teaching in this patent with respect to the selection of the phthalocyanine in combination with a lecithin charge director. Furthermore, in U.S. Pat. No. 4,275,136 blue is selected as a pigment for a liquid developer, there being no reference in this patent with regard to the combination of such a pigment with lecithin. Examples of patents disclosing developers with phthalocyanine include Nos. 4,252,565 and 4,539,284. Furthermore, diclosed in U.S. Pat. Nos. 2,997,398; 3,082,171; 3,166,510; 4,056,494; 4,305,853; and 4,520,153 are the use of lecithin in dry electrophotographic inks and pigmented paints in coating compositions. Also of background interest are U.S. Pat. Nos. 4,707,429 relating to metallic soaps as adjuvants for electrostatic liquid developers; 4,702,985 directed to amino alcohols as adjuvants for liquid electrostatic developer; 4,702,984 relating to polybutylene succinimide as adjuvants for electostatic liquid developers; 4,681,831 directed to chargable resins for liquid electrostatic developers comprising partial esters of 3-hydroxy propanesulunic acid; 4,670,370 relating to processes for the preparation of colored liquid toners; 4,663,264 directed to liquid electrostatic developers containing aromatic hydrocarbons; and No. 4,631,244 relating to process for the preparation of liquid developers with polar additives for electrostatic imaging processes.

Other prior art of interest includes U.S. Pat. Nos. 4,454,215 and 4,058,774 directed to liquid developers, and more specifically suitable toner particles present in a specific liquid carrier so as to form readily disassociated flocs, reference column 4, lines 63 to 68, and continuing on to column 5, lines 1 to 14. Patents primarily of background interest are Nos. 4,306,009; 4,363,863; 4,374,918 and 4,521,505.

Although the above described liquid developers are suitable for their intended purposes, there remains a need for improved liquid developers, particularly those that can be positively charged. There also remains a need for liquid developers that can be selected for rendering visible images present on negatively charged layered photoconductive members. Furthermore, there is a need for liquid developers with excellent transfer efficiencies and suitable optical densities. Also, there remains a need for developer compositions useful in single pass two color electrophotographic imaging processes.

Furthermore, there remains a need for positively charged liquid developers which can be selected for discharge area development on positively charged imaging members such as selenium or selenium alloy photoreceptors.

SUMMARY OF THE INVENTION

It is an object of the present invention to provide improved liquid developer compositions.

In another object of the present invention there are provided positively charged liquid developer compositions which can be selected for utilization in several different imaging processes, particularly xerographic highlight color imaging methods.

It is an additional object of the present invention to provide positively charged liquid developers useful for rendering visible images present on negatively charged photoconductive members.

Additionally, another object of the present invention resides in liquid developers with excellent transfer efficiencies.

Furthermore, another object of the preset invention resides in positively charged liquid developers which can be selected for affecting developing of charged areas of negatively charged imaging members of charge receptors, and which developers can also be utilized for affecting development of discharged areas on positively charged receptors or photoreceptors inclusive of amorphous selenium or amorphous selenium alloys.

Also, in another important object of the present invention there are provided positively charged liquid developer compositions comprised of a lecithin charge director, and as pigment particles the beta crystalline form of copper phthalocyanine available from BASF.

These and other objects of the present invention are accomplished by the provision of positively charged liquid developer compositions. More specifically, in one embodiment the present invention is directed to liquid developer compsitions comprised of polymer particles, nonpolar dispersant liquids, the beta crystalline form of copper phthalocyanine, Pigment Blue 15:3, Color Index Cl 741060:3, as pigment particles and available from BASF; and as a charge director lecithin. While the prior art teaches lecithin as a charge director, the inks resulting therefrom are negatively charged rather than positively charged as are the liquid inks of the present invention primarily because of the combination of components included in the aforementioned liquid inks.

Illustrative examples of nonpolar dispersant liquids present in an amount of from about 85 percent by weight to about 99.9 percent by weight, and preferably about 98 percent by weight, selected for the liquid inks of the present invention include hydrocarbon liquids, branched hydrocarbons, and aliphatic hydrocarbons such as Isopar® G, Isopar® H, Isopar® K, Isopar® L, Isopar® M, Isopar® V, Magiesol, particularly Magiesol 60; light mineral oils such as Marcol 52 or Marcol 62, available from Exxon Corporation; and the like.

As resin or polymer particles for the liquid inks of the present invention there are selected known materials including the commercially available Elvax resins, reference for example U.S. Pat. No. 4,707,429, the disclosure of which is totally incorporated herein by reference. A particularly preferred resin selected from the inks of the present invention is Elvax 5720. These resins are generally present in the ink composition in various effective amounts, and generally in an amount of from about 40 percent to about 99 percent by weight, and preferably in an amount of from about 75 percent by weight to about 90 percent by weight.

To enable the positively charged ink compositions of the present invention, there is selected as the pigment in an amount of, for example, from about 1 percent to about 60 percent, and preferably from about 10 to about 25 percent, the beta crystalline form of copper phthalocyanine available from BASF as K7080 Pigment blue 15:3, Color Index C1741060:3.

With further respect to the present invention, the liquid inks illustrated herein can be prepared by known methods including simply admixing the various components for a sufficient period of time, and thereafter separating the desired ink compositions from the mixture. More specifically, the inks of the present invention can be prepared as illustrated in some of the prior art patents mentioned herein including U.S. Pat. No. 4,707,429 and British Publication 2,169,416, the disclosures of which are totally incorporated herein by reference.

In one method of preparation for the inks of the present invention, there is initially heated the polymr and dispersant, blending them in a mixer such as a Ross double planetary mixer, subsequently blending in the pigment at the desired weight ratio to the polymer and dispersant, and cooling the mixture while continuing blending to form a paste like material. This mixture is subsequently diluted with hydrocarbon solvent dispersant, and placed in a mechanical grinding device such as a Union Process attritor, and ground until the desired particle size is achieved. Alternately, the polymer, pigment, and dispersant can be blended together in a heated grinding device such as a Union Process attritor. After a suitable blending time, the grinding device is cooled and grinding is continued until the desired particle size is achieved. The final ink is obtained by diluting to the desired weight of developer solids and adding the desired amount of charge director.

As indicated herein, the liquid developer compositions of the present invention are particularly useful in liquid development systems such as those illustrated in the aforementioned British Patent Publication, color proofing processes, and single pass two color imaging methods. These processes generally involve depositing an electrostatic negative charge pattern on a photoreceptor or dielectric surface, and subsequently affecting development of the electrostatic image formed thereon with a liquid developer of the present invention, followed by transfer of the developed image to a suitable substrate such as plain paper.

Examples of imaging members that may be selected include various known organic photoreceptors, including layered photoreceptors. Illustrative examples of layered photoresponsive members include those with a substrate, a photogenerating layer, and a transport layer as disclosed in U.S. Pat. No. 4,265,990, the disclosure of which is totally incorporated herein by reference. Examples of photogenerating layer pigments are trigonal selenium, metal phthalocyanines, metal free phthalocyanines, and vanadyl phthalocyanines. Charge transport material examples include various diamines dispersed in resious binders. Further, other imaging members that can be selected are selenium and selenium alloys, zinc oxide, cadmium sulfide, hydrogenated amorphous silicon, as well as ionographic surfaces of various dielectric materials, such as polycarbonate polysulfone fluoropolymers, and anodized aluminum alone or filled with wax expanded fluoropolymers.

The following examples are being supplied to further define specific embodiments of the present invention, it being noted that these examples are intended to illustrate and not limit the scope of the present invention. Parts and percentages are by weight unless otherwise indicated.

EXAMPLE I

A Ross double planetary jacketed mixer, model LDM-2, which was charged with 774 grams of DuPont Elvax II 5720 and 373.5 grams of Exxon Isopar® L was heated by an oil bath to 275° to 285° F. at a mixer setting of 6.5. After one hour, 83 grams of pigment BASF Heliogen Blue K7080, Color Index C1741060:3, was mixed with 290.5 grams of Isopar® L, and added to the mixer. Subsequently, and when another hour had elapsed, four additions of 332 grams of Isopar® L, preheated to about 203° F., were made at 10 minute intervals. After 3.25 hours, the hot oil bath was turned off and the mixer setting lowered to 2. The material was then allowed to mix and cool for another 5 hours. The resultant product was a solid mass or gel.

Eight-four and six tenths (84.6) grams of the resulting material and 135.4 grams of Isopar® L were added to a Union Process Model 01 attritor containing 983 grams of 3/16 inch stainless steel balls. The attritor was jacketed and heated with a circulating water bath at 37° to 39° C. The resulting mixture was milled for 12 hours at a setting of 50. At the end of this time the material had an average diameter particles size of 2.80 microns by volume as measured with a Horiba model CAPA-500 centrifugal automatic particle analyzer, manufactured by Horiba Instruments, Inc., Irvine, Calif., using a centrifugal rotation speed of 2,000 RPM, and a particle size range from 0.01 to 5.00 microns reported in 0.30 micron divisions. Thereafter, there was added to the ink generated 25 milligrams of the charge director lecithin.

The resulting liquid ink composition was then diluted to 2 percent by weight solids (resin and pigment weight divided by the total ink weight), and the charge measured on a deposition cell apparatus. The deposition cell apparatus consisted of an aluminum base plate which became the negative elecrode on which was placed an aluminum weighing dish, which became the positive electrode. The positive electrode was separated from the negative electrode by 3 one millimeter thick Teflon discs. Ink was then added to fill the void between the electrodes. A circuit was constructed and 1,300 volts were applied directly to the cell. The charge that passed through the cell during the four second period after the 1,300 volts were applied along with the mass collected on the aluminum pan. With this ink charged to a level of 25 milligrams/gram of lecithin (25 milligrams of lecithin per gram of ink solids), no mass deposited on the positively charged aluminum pan, rather a deposit was observed on the aluminum base plate. This ink was tested in a modified Savin 5040 machine, but no development was observed, as expected since this machine was operable for negatively charged liquid developer.

EXAMPLE II, III, and IV

A number of liquid developer compositions were prepared, reference Table 1 which follows, by esentially repeating the procedure of Example I. More specifically, these liquid inks were prepared as follows:

A Union Process Model 01-HD with a jackted mix can was charged with 1,730 grams of 3/16 inch stainless steel balls. A hot oil circulating bath was used to heat the mix can to about 115° C. The can was then charged with 25 grams of DuPont Elvax II 5720 resin and 125 grams of Exxon Isopar® L, followed by mixing at a speed of 2.4 for half an hour. Eight grams of BASF Heliogen Blue K7080 was then added and the mixture mixed for another 6.3 hours. The ink resulting was then diluted with Exxon Isopar® L dispersant to 2 percent developer solids by weight. The final ink was then charged with the amounts of lecithin as illustrated in the following Table 1. The final particle size obtained was 3.07 microns as measured wit the Horiba instrument described above.

A second ink was prepared by repeating the above procedure with the exception that the pigment was vacuum dried at 110° C. for two days prior to being formulated into an ink composition, and there resulted a final ink with an average particle size of 3.35 microns as measured with the Horiba instrument.

A third ink was prepared by repeating the above process with the exception that the pigment was washed with both water and methanol and subsequently dried prior to being formulated into an ink. The final ink was also ground for 23.8 hours to a final particle size of 1.95 microns as measured with the Horiba instrument described above. These inks are designated as Inks 1, 2, and 3, respectively. in Table 1 that follows.

Table 1 provides the measured charging data on these inks as a function of charge director concentration. The charge director used in all the inks 1, 2 and 3 was lecithin (purified grade, Fisher Chemical Company, Pittsburgh, Pa.) and the ink was diluted to 2 percent by weight ink solids. The conductivities were measured in picomhos/cm at 5 Hertz and 5 volts. Also, the data for these examples was accomplished with the pan charged positively and then charged negatively. A deposit on the pan was seen only when the pan was charged negatively indicating the ink was unipolar and positively charged.

TABLE 1

| Charge Director Concentration (mg/g) | Conductivity (picomhos/cm) | Charge/Mass (microcoulombs/gram) | Deposited Mass (grams) | Polarity of Ink |
|---|---|---|---|---|
| | | INK 1 | | |
| 5.0 | 2.0 | 21.4 | 0.0350 | positive |
| 15.0 | 21.0 | 92.5 | 0.0217 | positive |
| 26.6 | 43.0 | 186.2 | 0.0096 | positive |

TABLE 1-continued

| Charge Director Concentration (mg/g) | Conductivity (picomhos/cm) | Charge/Mass (microcoulombs/gram) | Deposited Mass (grams) | Polarity of Ink |
|---|---|---|---|---|
| 40.0 | 65.0 | 343.8 | 0.0058 | positive |
| | | INK 2 | | |
| 5.0 | 0 | 11.8 | 0.0090 | positive |
| 15.0 | 23.5 | 200.0 | 0.0088 | positive |
| 26.6 | 48.0 | 298.0 | 0.0061 | positive |
| 40.0 | 75.0 | 512.0 | 0.0036 | positive |
| | | INK 3 | | |
| 26.6 | 41.0 | 195.0 | 0.0100 | positive |

EXAMPLE V

A Union Process Model 1S attritor with a 1.5 gallon mix can was charged with 39 grams of BASF Heliogen Blue K7080 blue pigment, 156 grams of DuPont Elvax II 5720 resin and 842 grams of Isopar® L. The can was heated with steam at 230° F. and mixed at 230 RPM for one hour. At the end of an hour, the steam was turned off, the RPM turned down to 210, and 588 more grams of Isopar® L were added to the mix can. After 20 minutes, the mixer was turned back up to 350 RPM and ground for another six and three quarters hours. This resulted in an ink composition with a particle size of 2.57 microns as measured with the Horiba instrument described above.

The above prepared ink was tested in a modified Savin 5040 machine; the reverse roll spacing was changed to 75 microns; and the following biases and corotron voltages were powered by external power supplies. The antideposition bias was changed from −750 volts to +750 volts, the development electrode bias was changed from +200 volts to +600 volts, the transfer corotron was changed from +660 volts to −660 volts, and the reverse roll bias was changed from +200 volts to +600 volts. These changes were accomplished to enable running a positive ink on this machine using discharge area development. The ink was initially supplied to the machine at 2 percent developer solids concentration and charged with 10 milligrams of lecitin per gram of developer solids. Prints with output densities of 0.46, 0.46, 0.38 and 0.75 resulted at lecithin charge director concentrations of 10, 20, 30 and 40 milligrams/gram. Repeating the above imaging test resulted in output densities of 1.12, 0.99, 0.96 and 1.10 at lecithin concentrations of 10, 15, 20 and 25 milligrams/gram.

EXAMPLE VI

This procedure of Example V was repeated with the exception that the grinding portion of the processing was accomplished for six hours resulting in ink products with a particle size of 2.44, 2.62, and 2.62 microns respectively, as measured with the Horiba instrument. These inks were then combined to provide a single ink with a Horiba measured particle size of 2.56 microns.

Thereafter, the ink was diluted with Isopar® G dispersant to 2 percent developer solids and then the ink was charged at a level of 15 milligrams of lecithin per gram of developer solids. Subsequently, the aforementioned ink was incorporated into a liquid ink imaging testing apparatus with no fuser, and which apparatus contained two developer housings, the first housing containing a positive blue ink obtained from Example I, and the second housing containing a similar ink which had a negative charge thereon and contained no copper phthalocyanine pigment particles. The Savin machine was adjusted to enable single pass highlight color using trilevel development, and the photoreceptor selected was an arsenic selenium alloy (1BT) charged initially to abut 1,250 volts. The bias on the blue developer housing was varied between approximately 400 and 540 volts, resulting in a development potential for the blue images of roughly 200 to 340 volts. Over this range, acceptable blue ink development was observed on the photoreceptor. A pretransfer corotron was installed in the machine, the purpoe of which was to reverse the sign of the positive blue ink so that the normal positive transfer corotron would result in acceptable ink transfer.

Acceptable unfused blue and black images with minimum background deposits resulted.

Other modifications of the present invention will occur to those skilled in the art subsequent to a review of the present application. These modifications, and equivalents thereof are intended to be included within the scope of this invention.

EXAMPLE V

A Union Process Model 1S attritor with a 1.5 gallon mix can was charged with 39 grams of BASF Heliogen Blue K7080 blue pigment, 156 grams of DuPont Elvax II 5720 resin and 842 grams of Isopar® L. The can was heated with steam at 230° F. and mixed at 230 RPM for one hour. At the end of an hour, the steam was turned off, the RPM turned down to 210, and 588 more grams of Isopar® L were added to the mix can. After 20 minutes, the mixer was turned back up to 350 RPM and ground for another six and three quarters hours. This resulted in an ink composition with a particle size of 2.57 microns as measured with the Horiba instrument described above.

The above prepared ink was tested in a modified Savin 5040 machine; the reverse roll spacing was changed to 75 microns; and the following biases and corotron voltages were powered by external power supplies. The antideposition bias was changed from −750 volts to +750 volts, the development electrode bias was changed from +200 volts to +600 volts, the transfer corotron was changed from +660 volts to −660 volts, and the reverse roll bias was changed from +200 volts to +600 volts. These changes were accomplished to enable running a positive ink on this machine using discharge area development. The ink was initially supplied to the machine at 2 percent developer solids concentration and charged with 10 milligrams of lecithin per gram of developer solids. Prints with output densities of 0.46, 0.46, 0.38 and 0.75 resulted at lecithin charge director concentrations of 10, 20, 30 and 40 milligrams/gram. Repeating the above imaging test resulted in output densities of 1.12, 0.99, 0.96 and 1.10 at lecithin concentrations of 10, 15, 20 and 25 milligrams/gram.

EXAMPLE VI

This procedure of Example V was repeated with the exception that the grinding portion of the processing was accomplished for six hours resulting in ink products with a particle size of 2.44 2.62, and 2.62 microns respectively, as measured with the Horiba instrument. These inks were then combined to provide a single ink with a Horiba measured particle size of 2.56 microns.

Thereafter, the ink was diluted with Isopar® G dispersant to 2 percent developer solids and then the ink was charged at a level of 15 milligrams of lecithin per gram of developer solids. Subsequently, the aforementioned ink was incorporated into a liquid ink imaging testing apparatus with no fuser, and which apparatus contained two developer housings, the first housing containing a positive blue ink obtained from Example I, and the second housing containing a similar ink which had a negative charge thereon and contained no copper phthalocyanine pigment particles. The Savin machine was adjusted to enable single pass highlight color using trilevel development, and the photoreceptor selected was an arsenic selenium alloy (1BT) charged initally to about 1,250 volts. The bias on the blue developer housing was varied between approximately 400 and 540 volts, resulting in a development potential for the blue images of roughly 200 to 340 volts. Over this range, acceptable blue ink development was observed on the photoreceptor. A pretransfer corotron was installed in the machine, the purpose of which was to reverse the sign of the positive blue ink so that the normal positive transfer corotron would result in acceptable ink transfer.

Acceptable unfused blue and black images with minimum background deposits resulted.

Other modifications of the present invention will occur to those skilled in the art subsequent to a review of the present application. These modifications, and equivalents thereof are intended to be included within the scope of this invention.

What is claimed is:

1. A positively charged liquid developer composition comprised of polymer particles, a hydrocarbon liquid component, a charge director comprised of lecithin, and as pigment particles the beta crystalline form K7080 of copper phthalocyanine.

2. An ink composition in accordance with claim 1 wherein the polymer particles are Elvax.

3. An ink composition in accordance with claim 2 wherein the polymer component particles are Elvax II 5720.

4. An ink composition in accordance with claim 1 wherein the polymer component is present in an amount of from about 90 percent by weight to about 75 percent by weight.

5. An ink composition in accordance with claim 1 wherein the pigment particles are present in an amount of from about 10 percent by weight to about 25 percent by weight.

6. An ink composition in accordance with claim 1 wherein the charge director is present in an amount of from about 0.5 percent by weight to about 5 percent by weight of the pigmented polymer particles.

7. An ink composition in accordance with claim 1 wherein the copper phthalocyanine is Pigment Blue 15:3, Color Index No. C1741060:3, Heliogen Blue K7080.

8. An ink composition in accordance with claim 1 wherein the hydrocarbon liquid is an Isopar®.

9. An ink composition in accordance with claim 7 wherein the Isopar® is selected from the group consisting of Isopar® G and L.

10. A method for affecting the development of negatively charged images which comprises providing a negatively charged imaging member; subsequently developing the images formed with the ink composition of claim 1; thereafter tranferring the developed image to a suitable substrate; and optionally permanently affixing the image thereto.

11. A method of imaging in accordance with claim 10 wherein the developed image is transferred to a substrate in an amount of from about 80 to about 95 percent.

12. A method of imaging in accordance with claim 10 wherein the substrate is paper.

13. A method of imaging in accordance with claim 10 wherein the ink selected contains therein a copper phthalocyanine Pigment Blue 15:3, Color Index No. C1741060:3, Heliogen Blue K7080.

14. A method for affecting the development of negatively charged images which comprises providing a negatively charged imaging member; subsequently developing the images formed with the ink composition of claim 6; thereafter transferring the developed image to a suitable substrate; and optionally permanently affixing the image thereto.

15. A method in accordance with claim 14 wherein the hydrocarbon liquid for the ink is Isopar®.

* * * * *